US005469242A

United States Patent [19]

Yu et al.

[11] Patent Number: 5,469,242

[45] Date of Patent: Nov. 21, 1995

[54] CORONA GENERATING DEVICE HAVING A HEATED SHIELD

[75] Inventors: Robert C. U. Yu, Webster; Geoffrey M. T. Foley, Fairport; William G. Herbert, Williamson; William W. Limburg, Penfield; Satchidanand Mishra, Webster; Richard L. Post, Penfield; Donald C. Von Hoene, Fairport, all of N.Y.

[73] Assignee: Xerox Corporation, Stamford, Conn.

[21] Appl. No.: 389,084

[22] Filed: Feb. 14, 1995

Related U.S. Application Data

[63] Continuation of Ser. No. 952,029, Sep. 28, 1992, abandoned.

[51] Int. Cl.[6] ..... G03G 15/00

[52] U.S. Cl. ..... 355/219; 250/324; 355/221; 361/230

[58] Field of Search ..... 355/219, 222, 355/221; 361/230, 235, 225, 229; 250/324, 325, 326

[56] References Cited

U.S. PATENT DOCUMENTS

| | | | |
|---|---|---|---|
| 3,621,244 | 11/1971 | Miyakawa | 250/49.5 |
| 3,675,096 | 7/1972 | Kiess | 250/326 |
| 3,679,929 | 7/1972 | Holm et al. | 315/5.38 |
| 3,845,307 | 10/1974 | Gallo | 250/326 |
| 4,077,803 | 3/1978 | Gravel | 96/1.1 |
| 4,525,722 | 6/1985 | Sachder et al. | 346/1.1 |
| 4,585,321 | 4/1986 | Toshimitsu et al. | 250/325 |
| 4,585,322 | 4/1986 | Reale | 250/325 X |
| 4,710,450 | 12/1987 | Naito | 430/351 |
| 4,809,027 | 2/1989 | Boyer et al. | 346/159 |
| 4,920,266 | 4/1990 | Reale | 250/324 |
| 4,939,549 | 7/1990 | Endo et al. | 355/271 |
| 5,015,863 | 5/1991 | Takeshima et al. | 250/515.1 |
| 5,087,944 | 2/1992 | Yamauchi | 355/255 |
| 5,115,279 | 5/1992 | Nishikawa et al. | 355/290 |
| 5,136,329 | 8/1992 | Sugiura | 355/30 |

FOREIGN PATENT DOCUMENTS

| | | | |
|---|---|---|---|
| 2251464 | 10/1991 | Japan | G03G 15/00 |
| 3288174 | 12/1991 | Japan | G03G 15/02 |

OTHER PUBLICATIONS

"Electric Paint"; Popular Science Magazine, Jun., 1991 p. 45.

*Primary Examiner*—A. T. Grimley
*Assistant Examiner*—Thu Dang
*Attorney, Agent, or Firm*—Denis A. Robitaille

[57] ABSTRACT

A corona generating device of the type having a conductive shield partially surrounding a corona discharge electrode is provided with heating element. The heating element raises the surface temperature of the conductive shield to reduce or eliminate the adsorption of corona effluents and thereby minimize or prevent copy quality defects.

14 Claims, 2 Drawing Sheets

CORONA GENERATING DEVICE HAVING A HEATED SHIELD

This is a continuation of application Ser. No. 07/952,029, filed Sep. 28, 1992, abandoned.

The present invention relates generally to electrostatographic printing and, in particular, to corona generating devices.

Electrostatographic reproducing apparatus commonly used today typically include a photoconductive member which may be electrostatically charged and thereafter exposed to a light image of an original document for reproduction thereof. Exposure of the photoconductive member discharges the surface thereof in background areas to create an electrostatic latent image on the photoconductive member corresponding to the image areas contained within the original document. Thereafter, the electrostatic latent image on the photoconductive member is made visible by developing the image with a developing material. During development, carrier granules transport toner particles to the surface of the photoconductive member and the toner particles are attracted from the carrier particles by the charge pattern of the image areas on the photoconductive member, forming a powder image on the surface of the photoconductive member. This powder image may be subsequently transferred to a support surface, such as copy paper, to which the image may be permanently affixed by various methods. Following transfer of the powder image to the support surface, the photoconductive member may be discharged and cleaned of residual toner to prepare the surface thereof for the next imaging cycle.

Various types of charging devices have been used to charge or precharge a photoconductive member. In commercial use, for example, various types of corona generating devices exist, wherein a high voltage of 5,000 to 10,000 volts may be applied across an electrode to produce a corona spray which imparts electrostatic charge to the surface of the photoconductive member.

One particular corona generating device includes a single corona wire strung between insulating end blocks mounted on either end of a channel or shield. Another device, frequently used to provide more uniform charging and to prevent overcharging, includes two or more corona generating electrodes with a control grid or screen having a plurality of parallel wires or apertures in a plate positioned between the corona generating electrodes and the photoconductive member. A potential having the same polarity as that applied to the corona generating electrodes but having a much smaller voltage magnitude, usually on the order of a few hundred volts, is applied to the control grid to suppress the electric field between the control grid and the corona electrodes, markedly reducing the ion current flow to the photoconductive member.

Yet another type of corona charging device is described in U.S. Pat. No. 4,086,650 to Davis et al. That patent describes a corona discharge electrode which is coated with a relatively thick dielectric material such as glass for substantially preventing the flow of conduction current therethrough. In this device, the delivery of charge to the photoconductive surface is accomplished by a displacement current or by capacitive coupling through the dielectric material. The flow of charge to the surface to be charged is regulated by means of a DC bias applied to the shield of the corona generating device. In operation, an AC potential of approximately 5,000 to 7,000 volts at a frequency of about 4 KHz applied to the coated electrode produces an actual corona generating current of approximately 1 to 2 milliamps. This device has the advantage of providing a uniform charge to the photoconductive member using a relatively low maintenance charging device. This type of device is also highly insensitive to contamination by dirt and therefore does not require repetitive cleaning.

The corona generating electrode disclosed in the patent to Davis et al. is a coated wire supported between insulating end blocks wherein the device has a conductive auxiliary DC electrode positioned opposite to the imaging surface on which the charge is to be placed. In other conventional corona discharge devices, the conductive corona electrode may also be in the form of a pin array or may simply comprise an elongated wire supported between a pair of end blocks. Typically, the electrode is partially surrounded by a conductive shield which is usually electrically grounded. The surface to be charged is spaced from the electrode opposite the shield and is mounted on a conductive substrate.

In addition to providing a charge on certain types of photoreceptors, it is often desirable to provide a precharge to certain types of photoreceptors, such as a selenium alloy based image receptor, prior to providing a second charge thereto. Precharging is used to neutralize any charge remaining on the photoreceptor after transfer of the developed toner image to the copy sheet and to clean the photoreceptor in preparation for the next copying cycle. Typically, such a precharge corona generator operates at an AC potential of between 4,500 and 6,000 volts rms at 400 to 600 Hz. A conventional corona discharge device of this type is shown generally in U.S. Pat. No. 2,836,725 in which a conductive corona electrode in the form of an elongated wire is connected to a corona generating AC voltage source.

Certain difficulties have been observed when using corona generating charge devices. A primary problem exists in that various nitrogen oxide species are produced by the corona. These nitrogen oxide species are adsorbed by solid surfaces. In particular, it has been observed that these oxide species are adsorbed by the conductive shield as well as the housing and other components proximate to the corona generating device. This adsorption of nitrogen oxide species occurs despite the fact that, during operation, the corona generating device may be provided with a directed air flow for removing the nitrogen oxide species as well as for controlling ozone emissions. In fact, during the process of collecting ozone the air flow may exacerbate problems by carrying the nitrogen oxide species to an affected area of the charging device or even to some other machine part.

It has been found that adsorption can be a physically reversible process such that adsorbed nitrogen oxide species are gradually desorbed after such exposure when a machine is turned off for an extended period of idleness. It should be understood that, while the adsorbed and desorbed species are both nitrogenous, they may not necessarily be the same, i.e., there may be conversion of $NO_2$ to $HNO_3$. When the operation of the machine is resumed, a copy quality defect, commonly called a parking deletion, is observed wherein a line or band image deletion or lower density image is formed across the width of the photoreceptor at that portion which is at rest opposite the corona generating device during the period of idleness. It is believed that the nitrogen oxide species in some way interact with the surface of the photoreceptor to increase the lateral conductivity thereof, so that the photoreceptor cannot retain a charge according to the image configuration. This phenomenon basically causes narrow line or solid area images to blur or to wash out, so as not to be developed as a toner image.

Parking deletion defects have been observed with conventional selenium photoreceptors which generally comprise a conductive drum substrate having a thin layer of selenium or an alloy thereof deposited on the substrate surface to provide the imaging surface. The parking deletion problem has also been observed to occur with other photoreceptor configurations such as plates, flexible belts, and the like, as well as with other photoreceptor materials which may include one or more photoconductive layers on a supporting substrate. The supporting substrate may be conductive or may be coated with a conductive layer over which photoconductive layers may be coated. Alternatively, the multilayered electroconductive imaging photoreceptor may comprise at least two electrically operative layers, a photogenerating layer or a charge generating layer and a charge transport layer which are typically applied to the conductive layer. For further details of such a layer, attention is directed to U.S. Pat. No. 4,265,990. In these varying structures several of the layers may be applied through various known deposition techniques for creating very thin layers.

Exposure of the photoreceptor to the desorbing nitrogen oxide species during extended periods of idleness tends to increase the severity of the line defect or solid area deletions. While the mechanism is not fully understood, it has been observed that even after a relatively short period of machine operation, such as 15 minutes, coupled with a period of idleness of, say, several hours, a mild line defect and concurrent image deletion may be realized. During the initial stage of exposure of the photoreceptor to the desorbing nitrogen oxide species, the reaction between the photoreceptor and the nitrogen oxide species is purely at the surface. Thus, it is possible to rejuvenate the photoreceptor by washing or abrasively cleaning the surface with alcohol or other solvent. However, after a prolonged period of time the reaction tends to penetrate the surface layer of the photoconductive member such that the defect cannot be resolved simply by washing with a solvent. As indicated above, the defect is reversible to some degree by a rest period. However, the period involved may be on the order of several days which may be objectionable to an operator.

It has been found that the material from which the corona generating device, and in particular the shield, is fabricated or coated may have a significant effect on the severity of parking deletions. Attempts to solve that problem by plating the shield have met with limited success in that the plating often combines with the nitrogen oxide species to form a nitrate based deliquescent salt, which after continued use may become moist with water from the air. The salt buildup will eventually accumulate sufficient water such that droplets may form and drop off onto the photoreceptor. Furthermore, the nickel nitrate salts are crystalline and loosely bonded rather than a cohesive durable film. Another attempt to solve a similar difficulty in a negative charging AC device involves coating the shield and subsequently plating it with gold. Gold plating is theorized to provide a relatively inert surface which will not adsorb the nitrogen oxide species or will not permit conversion to a damaging form. However, as a result of the expense of gold, the gold is plated in a very thin layer and consequently the layer is discontinuous having numerous pores in the layer. The thin porous layer of gold permits the substrate underneath the gold to corrode, forming nitrates in the same manner as with an unplated device, generating similar difficulties which result in limited useful life.

In other attempts to eliminate the deletion problem associated with corona charging, considerable work has been done to reduce the adsorption of nitrogen oxides species by applying electrode coatings to component surfaces. Such coatings typically include a reactive metal base such as nickel, lead, copper, zinc or mixtures thereof. These reactive metal base materials tend to absorb nitrogen oxide species or form harmless compounds therewith. While the coatings described above are capable, to varying degrees, of performing satisfactorily in certain applications, difficulties still exist. Most generally, the coatings effective in neutralizing corona effects have been the alkali metal silicate, particularly potassium silicate with graphite suspended in aqueous media, as described in U.S. Pat. No. 4,585,322, and aluminum hydroxide also with suspended graphite, as described in U.S. Pat. No. 4,646,196. However, parking deletions have continued to be a problem due to the failure of the materials to continue to absorb or form harmless compounds with the nitrogen oxide species over time.

Accordingly, it is desirable to provide an improved and economical corona generating device for depositing a charge on an imaging surface wherein damaging nitrogen oxide species, generated by the corona generating process, adsorbed by components thereof, and desorbed when the device is inactivated, are neutralized. The following disclosures appear to be relevant:

U.S. Pat. No. 3,845,307 Patentee: Gallo Issued: Oct. 29, 1974

U.S. Pat. No. 4,920,266 Patentee: Reale Issued: Apr. 24, 1990

JP-02-251464 Assignee: Fuji Xerox Laid Open: Oct. 9, 1990

JP-03-288174-A Assignee: Canon, Inc. Laid Open: Dec. 18, 1991

"Electric Paint" Popular Science Magazine June, 1991

The relevant portions of the foregoing disclosures may be briefly summarized as follows:

U.S. Pat. No. 3,845,07 discloses an arrangement for connecting an exposed corona electrode to both a conventional high potential for generating a corona and a high current, low potential to bend the corona wire, making the electrode self-luminously incandescent.

U.S. Pat. No. 4,920,266 also addresses the problem of parking deletions caused by adsorption and desorption of nitrogen oxide species and provides a corona generating device having elements coated with a substantially continuous thin film of aluminum hydroxide containing graphite and powdered nickel. No heating of the elements is disclosed.

JP-02-251464 discloses an ion current control electrode substrate characterized in that a heating resistor is provided on the substrate body with a control electrode confronting the heating resistor through an insulating body.

JP-03-288174-A discloses an image forming device including electrostatic charging means in the form of a charging roller having a heating means for stabilizing the electrostatic charging process by eliminating environmental conditions.

Popular Science Magazine disclosed the introduction to market of an exothermic paint which radiates heat when current is passed through it, manufactured by Rustol Chemical Company of Tokyo, Japan.

In accordance with the present invention, a corona generating device is provided, including a corona discharge electrode, a conductive shield member defining an open-ended chamber having the corona discharge electrode disposed therein, and means for heating the conductive shield to raise the temperature thereof.

In accordance with another aspect of the present invention, an electrostatographic printing apparatus is provided with an improved corona generating device for depositing a charge on an imaging surface wherein the corona generating device includes a corona discharge electrode, a conductive shield member defining an open-ended chamber having the corona discharge electrode disposed therein, and means for heating the conductive shield to raise the temperature thereof.

For a better understanding of the present invention as well as other aspects and further features thereof, reference is made to the following drawings and descriptions.

Figure 1:
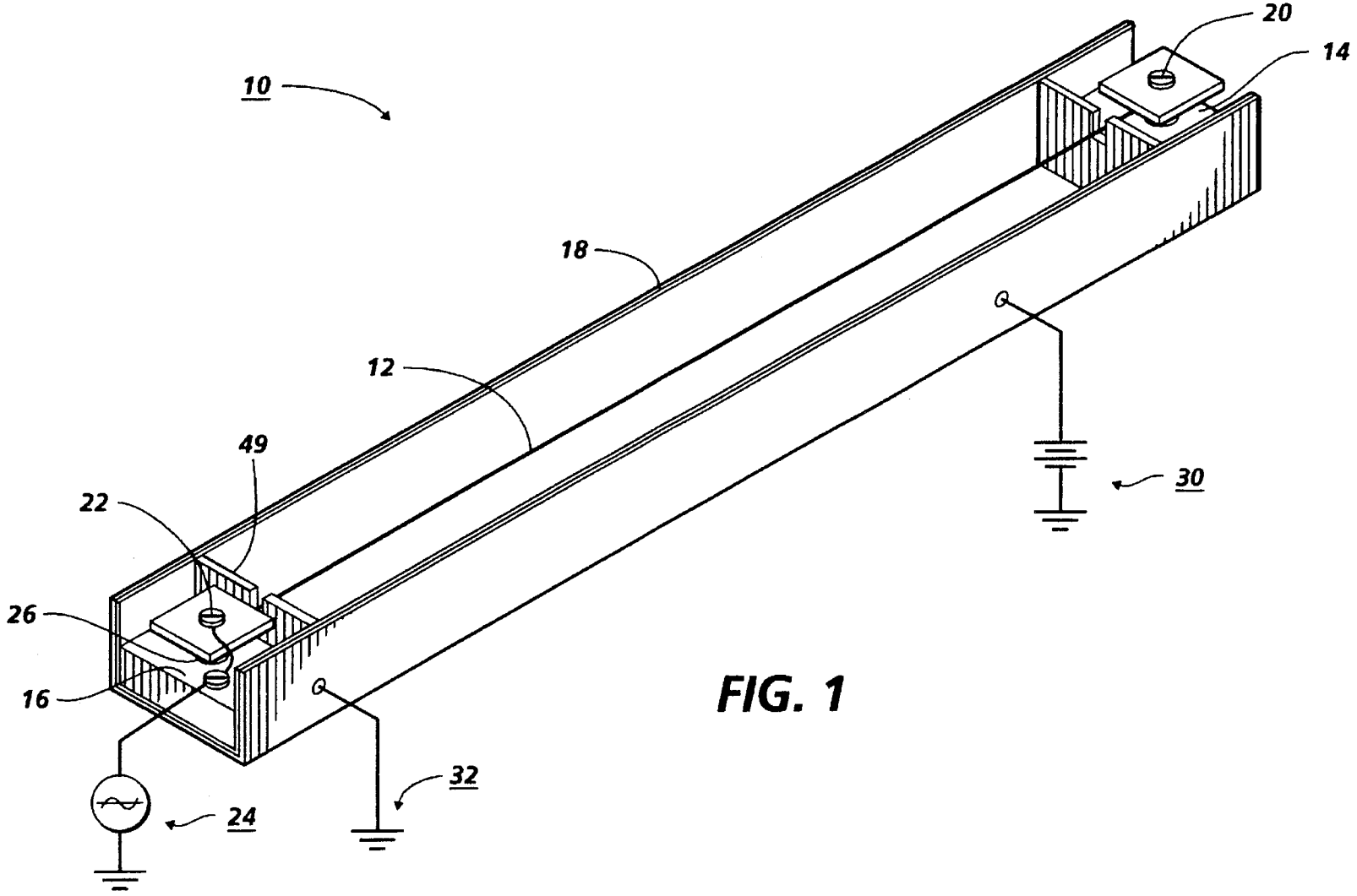
FIG. 1 is an isometric view of an exemplary corona discharge device according to the present invention.

Referring initially to FIG. 1, an exemplary embodiment of the present invention is shown, including a corona generating device 10 having a corona discharge electrode 12. For the purposes of the present description, the corona discharge electrode 12 is in the form of a singular elongated conductive wire. It will be understood, however, that the electrode 12 may take the form of dual conductive wires, a pin array, a wire having a relatively thick coating of dielectric material or any other configuration as may be known in the art. As such, the Figures and description of the present invention, as provided herein, are provided for the purpose of illustrating an exemplary embodiment of the present invention and are not intended to limit the same.

Corona discharge electrode 12 is supported between insulating end block assemblies 14 and 16, partially surrounded by a conductive shield member 18 forming a channel for increasing the ion density available for conduction. The corona discharge electrode 12 is fastened at one end to port 20 in the end block assembly 14 and at the other end to port 22 of end block assembly 16. A corona potential generating source 24 is coupled to the corona discharge electrode 12 through lead 26. The diameter of the wire 12 is not critical and may vary typically between 0.5–15 mils and is preferably about 9 mils. For the purposes of the illustrated exemplary embodiment, the corona discharge wire 12 may be made of any conventional conductive filament material such as stainless steel, gold, aluminum, copper, tungsten, platinum, or the like.

Operation of the corona generating device 10 for depositing a specific net charge on an imaging surface is preferably accomplished by applying AC voltage in the range from 4 KV to 7 KV across the corona discharge electrode 12 at a frequency between 1 KHz and 10 KHz. However, the frequency of the AC source 24 may be varied widely in the range from 60 Hz commercial source to several megahertz. A typical conventional corona discharge device of this type is shown generally in U.S. Pat. No. 2,836,725, issued to Vyverberg, wherein a conductive corona electrode in the form of an elongated wire is connected to a corona generating AC voltage. The contents of that patent are hereby incorporated in its entirety into the present patent application.

In accordance with the present invention, shield member 18 is advantageously provided with a heating means for raising the surface temperature of the shield. It has been found that modest increases in surface temperature of the shield 18 during operation of the corona generating device 10 will eliminate adsorption of the corona effluents on the surface of the shield 18 and, therefore, eliminate photoreceptor parking deletions caused by desorption of the corona effluents. Further, heating the corona generating device shield 18 increases the mass transport of contaminants away from the photoreceptor. An increase of 10° C. along the shield 18 surface raises the vapor pressure of the contaminants by as much as 100 times, thereby increasing the removal of contaminants from the area of the shield 18.

Figure 2:
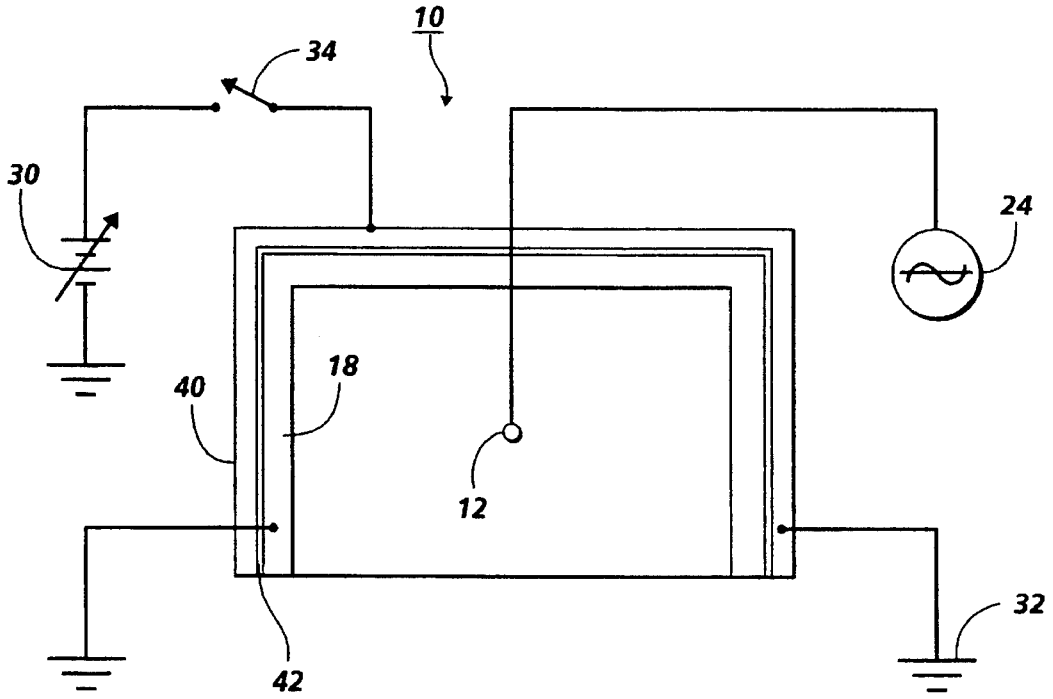
FIG. 2 is an enlarged cross-sectional view showing a preferred embodiment of a heated shield corona discharge device according to the present invention.

Referring now to FIG. 2, a preferred embodiment of the heated shield corona generating device of the present invention is shown wherein the shield 18 is coated along at least one surface thereof with a substantially continuous coating 40 of exothermic paint, as for example MRX-001 from Rustol Chemical Corporation of Tokyo, Japan. While such a composition is capable of performing satisfactorily, it will be understood by those of skill in the art that alternative embodiments may be utilized in order to generate significant heat along the surface of the shield 18. For example, a resistive element may be located adjacent to the shield 18 or may be embedded into the surface of the shield 18 to apply heat thereto.

The substantially continuous coating of exothermic paint may be formed on the surface of shield 18 by applying an organic solution or dispersion as a thin film thereto. The material could also be dispersed in a polymer binder to provide sufficient continuous coating. Typically the thin film can be formed by applying the coating solution or dispersion through spraying, including electrostatic spraying, or brushing as with a paint or by dip coating. Upon drying, which may be effected at ambient and elevated temperatures, the film provides a coherent coating with a strong adhesive bonding to the surface of the shield 18. The exothermic coating or dispersion is applied in a thickness that will not hinder the operation of the corona generating device. Typically, the exothermic paint is applied in a thickness which provides a coating thickness of between 0.3 to about 1.0 mils as a substantially uniform continuous layer absent of pores. The paint film may be applied in a singular layer or in multiple layers, as desired.

It is noted that in order to retain a conductive shield 18 which is maintained at ground potential, as may be required for appropriate operation of the corona generating device 10, an insulative layer may be required between the conductive shield 18 and the exothermic paint layer. As such, the following exemplary embodiments as illustrated in FIGS. 2 and 3 are provided.

Referring again to FIG. 2, the conductive shield 18 is coated along its exterior surface with a first insulating layer 42. The insulating layer 42 may be formulated from various materials which may include any suitable insulating material applied to the conductive shield 18 by any suitable means, as for example, a Mylar strip which is adhesively applied to the conductive shield 18. Another suitable approach might include the lamination of a polymeric insulation layer on conductive shield 18. In a preferred approach, a layer of insulation paint, such as, for example MRX-003 from Rustol Chemical Company, may be applied to provide enhanced heat transfer. Alternatively, layer 42 may be substituted with an infrared emitting material, such as, for example, MRX-002, also available from Rustol Chemical Company. A coating of exothermic paint 40 is then applied to the insulating layer 42 for providing means to heat the conductive shield 18. The exothermic paint layer is further coupled to a variable DC source 30 and a ground electrode 32 which allows current to flow through the exothermic paint to generate significant heat on the surface of the shield 18. The DC source 30 may be coupled to the heating means via a switch 34 which may be replaced by a thermocouple switch 36, as depicted in FIG. 3, selectively applying current to the heating means. For example, when a detected temperature is greater than a reference value, thermocoupled switch 36 may be opened to prevent current flow through the heating element and provide protection against exposure of machine parts to excessive heat.

Figure 3:
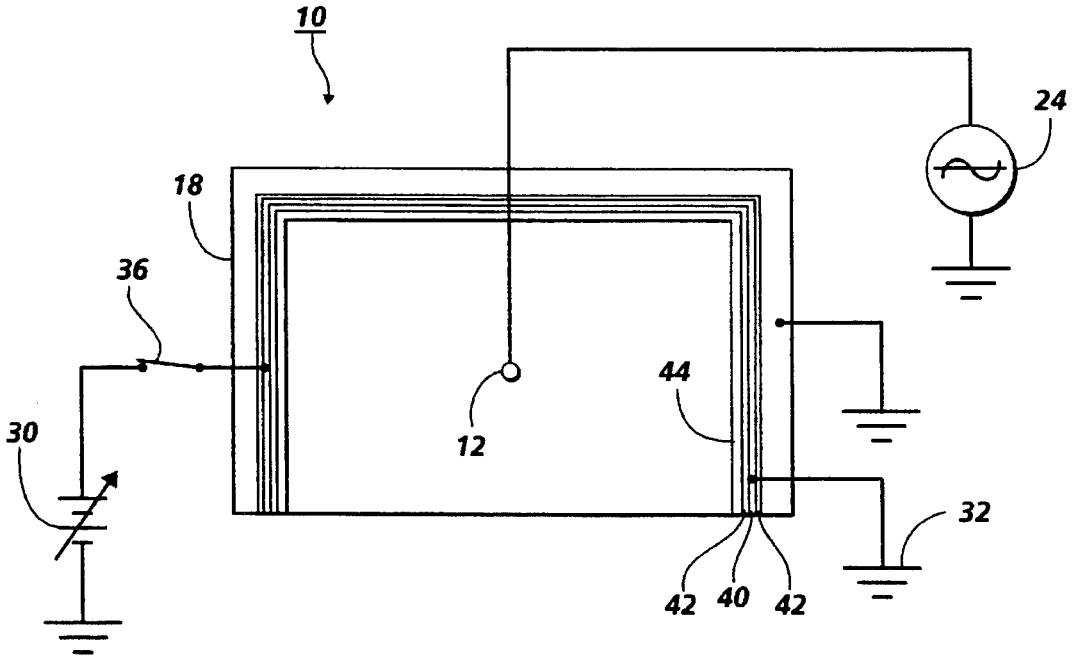
FIG. 3 is an enlarged cross-sectional view showing another preferred embodiment of a heated shield corona discharge device according to the present invention.

In an alternative embodiment, as shown in FIG. 3, the interior surface of the conductive shield 18 can be coated with an insulating layer which is provided with a coating of the exothermic paint. In this embodiment, a second insulating layer 42 (or alternatively, a layer of infrared emitting paint as discussed above) is applied to the exothermic paint to facilitate heat transfer and then covered by a metallic film or foil 44, as shown, thereby preventing direct exposure of the exothermic paint layer to the corona generated by electrode 12 while maintaining the electrostatic integrity of the corona generating device.

In recapitulation, it is evident that the corona generating device of the present invention comprises a heated conductive shield in the form of a conductive shield having a layer of exothermic paint. The exothermic paint layer is coupled to a power source for generating current therethrough to generate heat for raising the surface temperature of the conductive shield. Heating the conductive shield increases mass transport of contaminants by raising the vapor pressure of the contaminants, thereby increasing the removal of contaminants from the area surrounding the corona discharge electrode.

While the invention has been described with reference to the specific embodiments, it will be apparent to those skilled in the art that many alternatives, modifications, and variations may be made thereto. It is intended that the present disclosure embrace such modifications and alternatives as may fall within the spirit and scope of the appended claims.

We claim:

1. A corona generating device, comprising:

a corona discharge electrode for generating a corona;

a conductive shield member located in close proximity to said corona discharge electrode, defining a open-ended chamber having the corona discharge electrode disposed therein, said corona discharge electrode and said conductive shield member cooperating to generate an electrostatic field; and means for heating said conductive shield member to eliminate adsorption of corona effluents thereon so as to prevent image defects caused by desorption of corona effluents from said conductive shield member, said heating means including a substantially continuous layer of exothermic paint disposed on said conductive shield member.

2. The corona generating device of claim 1, wherein said heating means includes an electrical current source coupled to said exothermic paint layer for providing electrical current thereto.

3. The corona generating device of claim 2, wherein said heating means includes switch means coupled to said current source to selectively provide electrical current to said heating means.

4. The corona generating device of claim 3, wherein said switch means includes a thermostatically controlled switch.

5. The corona generating device of claim 1, wherein said layer of exothermic paint has a thickness ranging from about 0.3 to about 1.0 mils.

6. The corona generating device of claim 1, further including a layer of insulating material interposed between said shield member and said layer of exothermic paint.

7. The corona generating device of claim 1, including:

a first insulating layer disposed on an interior surface of said shield member, wherein said layer of exothermic paint is disposed on said first insulating layer;

a second insulating layer disposed on said layer of exothermic paint; and a metallic film layer disposed on said second insulating layer in proximity to said corona discharge electrode.

8. An electrostatographic printing apparatus including a corona generating device for depositing a charge on an imaging surface, comprising:

a corona discharge electrode for generating a corona;

a conductive shield member located in close proximity to said corona discharge electrode, defining an open-ended chamber having the corona discharge electrode disposed therein, said corona discharge electrode and said conductive shield member cooperating to generate an electrostatic field; and means for heating said conductive shield member to eliminate adsorption of corona effluents thereon so as to prevent image defects caused by desorption of corona effluents from said conductive shield member, said heating means including a substantially continuous layer of exothermic paint disposed on said conductive shield member.

9. The electrostatographic printing apparatus of claim 8, wherein said heating means includes an electrical current source coupled to said exothermic paint layer for providing electrical current thereto.

10. The electrostatographic printing apparatus of claim 9, wherein said heating means includes switch means coupled to said current source to selectively provide electrical current to said heating means.

11. The electrostatographic printing apparatus of claim 10, wherein said switch means includes a thermostatically controlled switch.

12. The electrostatographic printing apparatus of claim 8, wherein said layer of exothermic paint has a thickness ranging from about 0.3 to about 1.0 mils.

13. The electrostatographic printing apparatus of claim 8, further including a layer of insulating material interposed between said shield member and said layer of exothermic paint.

14. The electrostatographic printing apparatus of claim 7, including:

a first insulating layer disposed on an interior surface of said shield member, wherein said layer of exothermic paint is disposed on said first insulating layer;

a second insulating layer disposed on said layer of exothermic paint; and a metallic film layer disposed on said second insulating layer in proximity to said corona discharge electrode.

* * * * *